US006423273B1

(12) United States Patent
O'Mara

(10) Patent No.: US 6,423,273 B1
(45) Date of Patent: Jul. 23, 2002

(54) METHOD OF FORMING SEALS FOR A MICROFLUIDIC DEVICE

(75) Inventor: Kerry Dennis O'Mara, Lambertville, NJ (US)

(73) Assignee: Orchid BioSciences, Inc., Princeton, NJ (US)

( * ) Notice: Subject to any disclaimer, the term of this patent is extended or adjusted under 35 U.S.C. 154(b) by 0 days.

(21) Appl. No.: 09/315,216

(22) Filed: May 19, 1999

(51) Int. Cl.[7] ..... B01L 3/00

(52) U.S. Cl. ..... 422/102; 422/99; 422/101; 422/103

(58) Field of Search ..... 422/102, 99, 100, 422/103

(56) References Cited

U.S. PATENT DOCUMENTS 4,254,083 A 3/1981 Columbus
5,401,376 A 3/1995 Foos et al.
6,143,152 A * 11/2000 Simpson et al.
6,240,790 B1 * 6/2001 Swedburg et al.

FOREIGN PATENT DOCUMENTS

WO WO-91/16966 A1 * 11/1991

* cited by examiner

*Primary Examiner*—Jan Ludlow
(74) *Attorney, Agent, or Firm*—Kevin G. Mierzwa

(57) ABSTRACT

A microfluidic device has a seal or other component between two adjacent layers. The seal or other component is formed of a sheet of material having a first thickness. The seal material has boss portions that have a second thickness greater than the first thickness. A plurality of holes are formed through the boss portion. A method for making the seal layer includes the step of thinning the seal material between a first film and a second film. Bosses are formed in the film. Holes are cut through the boss area. One film is removed from the seal material and the seal material is applied to a substrate. The seal material is cured to a substrate and the second film is removed from the seal material. Other components such as diaphragm may be formed using the above process without punching holes through the seal material.

3 Claims, 3 Drawing Sheets

METHOD OF FORMING SEALS FOR A MICROFLUIDIC DEVICE

TECHNICAL FIELD

The present invention relates to microfluidic devices, and more particularly, to the sealing layers between with a device and a method of forming seals on a microfluidic device.

BACKGROUND OF THE INVENTION

Methods of making a homologous series of compounds, or the testing of new potential drug compounds comprising a series of light compounds, has been a slow process because each member of a series or each potential drug must be made individually and tested individually. For example, a plurality of potential drug compounds is tested by an agent to test a plurality of materials that differ perhaps only by a single amino acid or nucleotide base, or a different sequence of amino acids or nucleotides.

The processes described above have been improved by microfluidic chips which are able to separate materials in a micro channel and move the materials through the micro channel. Moving the materials through micro channels is possible by use of various electro-kinetic processes such as electrophoresis or electro-osmosis. Fluids may be propelled through various small channels by the electro-osmotic forces. An electro-osmotic force is built up in the channel via surface charge buildup by means of an external voltage that can repel fluid and cause flow.

In fluid delivery in microfluidic structures, several layers comprise the device. Channels often extend between the various layers. Because the fluid is under pressure, sealing the layers together to prevent leakage and cross contamination is extremely important.

Currently, the method for fabricating seals is very labor and time intensive. Therefore, the seals are not cost effective. For example, to fabricate a seal pattern with 144 seals takes in excess of 4 man hours. The current technology push is to develop microfluidic devices that have hundreds and even thousands of reaction chambers per cell. More reaction wells increases the need for effective and robust seals.

It would therefore be desirable to reduce the cost, time and labor associated with the fabrication of seals for microfluidic chip assemblies.

SUMMARY OF THE INVENTION

It is, therefore, one object of the invention to provide an improved fluid delivery mechanism to an array of reaction wells.

It is a further object of the invention to reliably seal the various layers. It is a further object of the invention to reduce the amount of labor and time and therefore cost in the production of seals.

In one aspect of the invention, a method of forming seals comprises:

- thinning a seal material between a first film and a second film;
- cutting holes in the seal material;
- applying the exposed seal material surface to a first substrate;
- curing the seal material; and
- removing the second film from the seal material.

One advantage of the invention is that the method of making seal layers may be automated to be more time efficient and therefore more cost effective.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

The present invention is described with respect to a seal for a microfluidic device. The present invention may also be used for other structures such as diaphragms as well.

Figure 1:
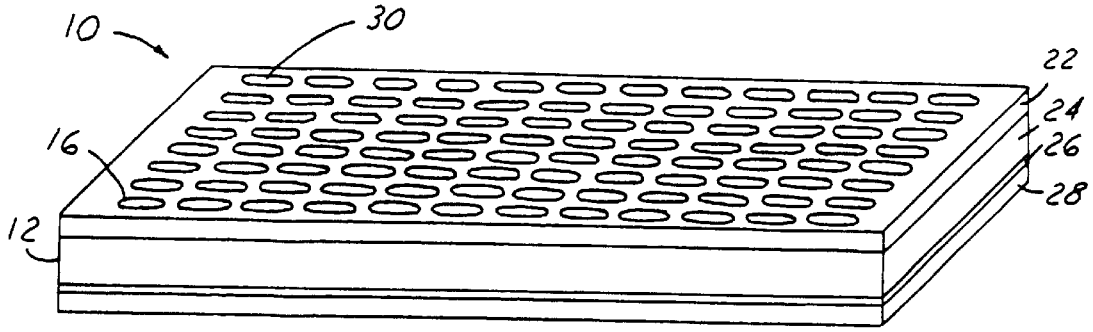
FIG. 1 is a schematic view of a fluid distribution system network formed according to the present invention.

Referring to FIG. 1, a microfluidic distribution system 10 is shown incorporated into a microfluidic device 12.

Fluid distribution system 10 has fluid inputs 16 coupled to a fluid source (not shown). Fluid inputs 16 are coupled to a main channel 18. Main channel 18 has a plurality of branches 20 extending therefrom. Main channel 18 is coupled to a fluid (not shown) that directs fluid outside of microfluidic device 12, which has not been diverted by one of the plurality of branches 20.

The fluid source is preferably a pressurized fluid source that provides pressurized fluid to main channel 18. Various types of pressurized fluid sources would be evident to those skilled in the art.

Figure 2:
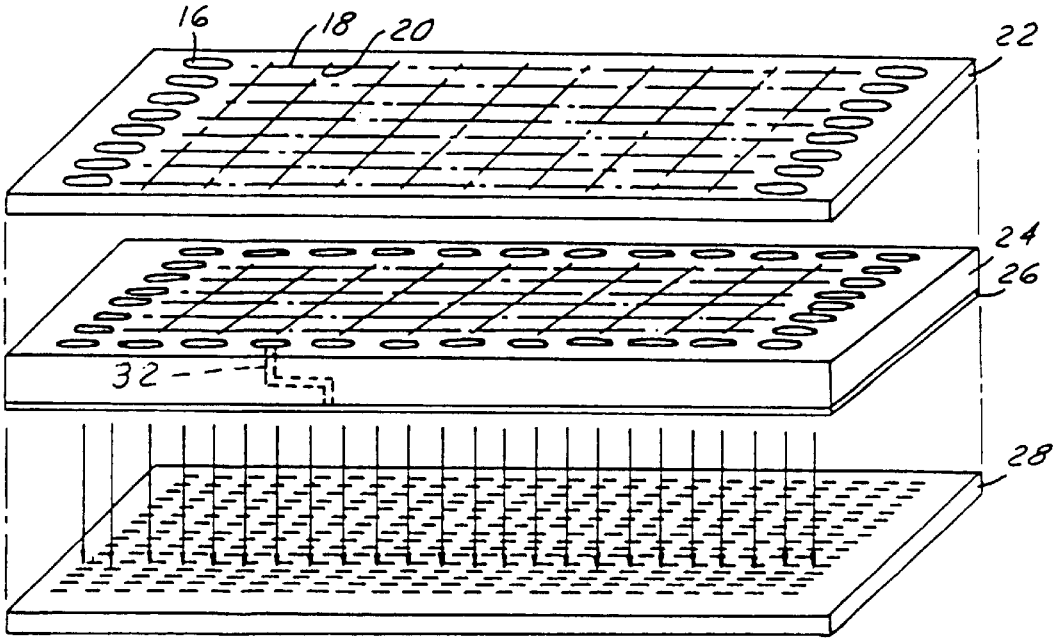
FIG. 2 is an exploded view of a microfluidic device.

Referring now also to FIG. 2, microfluidic device 12 is preferably comprised of a plurality of adjacent layers. In the present example, a top layer 22, a second layer 24, a component layer such as a seal layer 26 or diaphragm layer and a well layer 28 are used. The composition of each layer may, for example, be glass, silicon, or another suitable materials known in the art. Each layer may be bonded or glued together in a manner known to those skilled in the art. For example, the layers may be anodically bonded.

Second layer 24 is illustrated as single layer. However, second layer 24 may be comprised of several layers interconnected through fluid channels. Although only one seal layer 26 is shown for simplicity, one skilled in the art would recognize that a seal layer may be formed between any of the layers.

Branches 20 provide interconnections to well layer 28 through the various layers 22 through 32. The various openings and channels forming branches 20 may be formed in a conventional manner, such as by etching or drilling. Drilling may be accomplished by laser drilling.

Main channel 18 in the preferred embodiment is defined by first layer 22 and second layer 24. A cell feed 30 is formed between top layer 22 and within second layer 24. Cell feed 30 is coupled to main channel 18 through interlayer feed channel 32. Interlayer feed channel 32, as illustrated, is cylindrical in shape. However, interlayer feed channel 32 may also be conical in shape. Well layer 28 may be detachable from seal layer 26.

Figure 3:
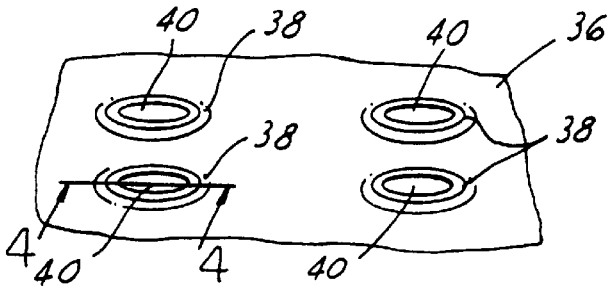
FIG. 3 is a perspective view of a seal layer formed according to the present invention.
Figure 4:
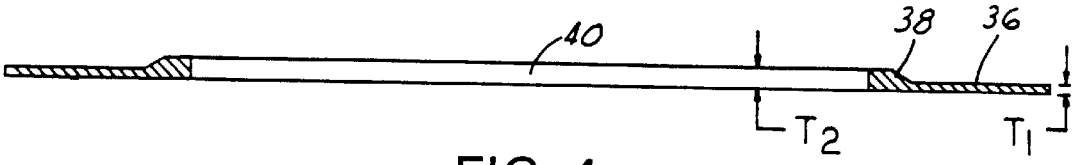
FIG. 4 is a partial enlarged cross sectional view of the seal layer of FIG. 3.

Referring now to FIGS. 3 and 4, sheet layer 26 (seal layer or component layer) has a web portion 36 that interconnects bosses 38. Each boss area 38 has a hole therethrough if used for sealing. Boss area 38 provides a seal between the substrates through which fluid is passed. Hole 40 is a fluid passage for fluid between various substrates.

If another component such as a diaphragm is to be formed, hole 40 may be reduced in thickness rather than punched all the way through layer 26.

As is best shown in FIG. 4, web portion 36 has a thickness $T_1$ while boss area 38 has a thickness $T_2$ greater than thickness $T_1$.

Figure 5:
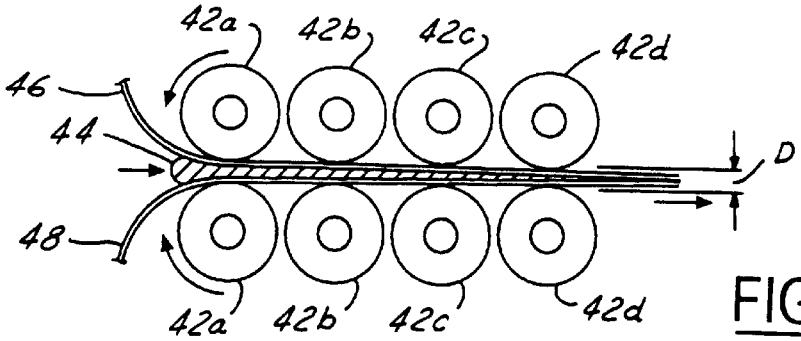
FIG. 5 is a side view of a thinning step for making a seal.

Referring now to FIG. 5, a first step and one method for forming a seal uses a plurality of pairs of rollers 42*a*, 42*b*, 42*c*, and 42*d*. The distance B between roller 42*a* is greater than the distance between rollers 42*d*. Rollers 42*a–d* are used to reduce the thickness of seal material. Distance D between rollers 42*d* is related to the desired final thickness of seal layer 26 at boss area 38, that is, $T_2$. Distance D may very depending on the compressibility of the material and subsequent processing steps. Rollers 42*a–d* are used to calendar seal material 44 down to the desired thickness. To prevent seal material 44 from adhering to rollers 42, seal material 44 may be placed between a first film 46 and a second film 48. First film 46 and second film 48 should be of a type not to stick to rollers 42 during processing. Suitable materials for films 46, 48 include polyester, Kapton™ (polyimide) and Teflon™ type films. It is important that the film is relatively smooth and strong and capable of withstanding subsequent processing conditions. Because the films are not to be used in the final product, it is important that the films 46, 48 easily release from the seal material 44 in an uncured and cured state.

Figure 6:
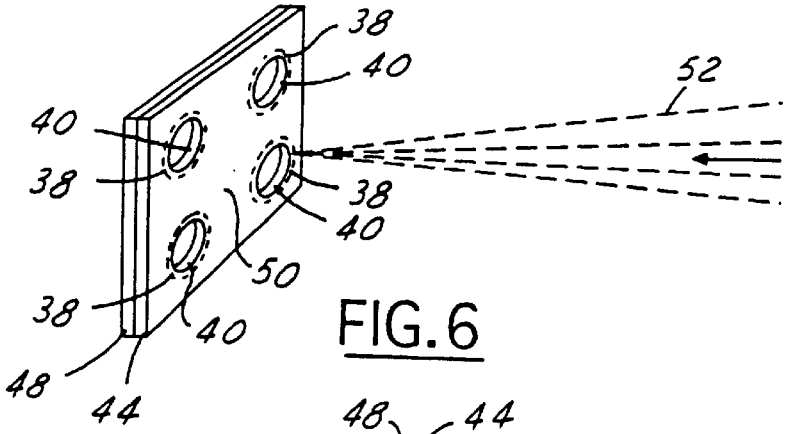
FIG. 6 is a perspective view illustrating hole cutting step in the method for forming a seal.

Referring now to FIG. 6, first film 46 is removed from seal material 44. This forms an exposed surface 50 on seal material 44.

Holes 40 are then cut through seal material 44 and second film 48. Although, it is not required that holes be cut through second film 48. Holes 40 may be formed by several methods including laser ablation using laser light 52. Another suitable method may be mechanical die cutting similar to that used for cutting labels. In this manner, the second film would not be cut. Laser light 52 is believed to be a relatively rapid source for the cutting of holes 40.

Boss area 38 may also be formed by laser ablation. That is, the area of exposed surface 50 outside boss area 38 may have the thickness reduced similar to that shown in FIGS. 3 and 4 above. By reducing the thickness outside boss area 38, seal material 44 at boss area 38 will stick to the substrate as will be further described below, and boss area 38 will provide the seal. The sealing forces will be concentrated in boss area 38.

Figure 7:
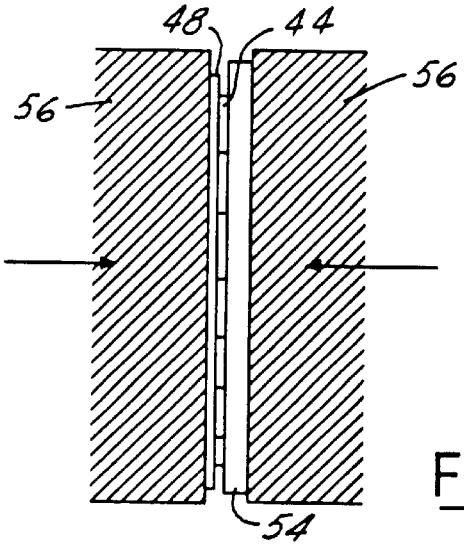
FIG. 7 is a side view of the steps of applying a seal to a substrate and curing the seal.

Referring now to FIG. 7, seal material 44 on second film 48 is then applied to a substrate 54. A pair of platens 56 of a die or press may be used to apply a clamping force to hold seal material 44 against substrate 54. The clamping force may be maintained while the seal material 44 is cured to substrate 54. To cure seal material 44, the temperature of seal material 44 must be raised to a predetermined temperature. For example, if an EP rubber or a perfluoroelastomer is used as seal material 44, the curing temperature is 175° C.

Figure 8:
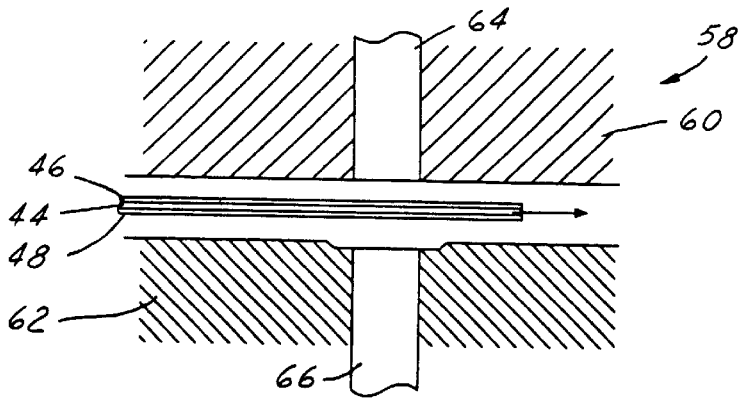
FIG. 8 is a punch device used to form seals.
Figure 9:
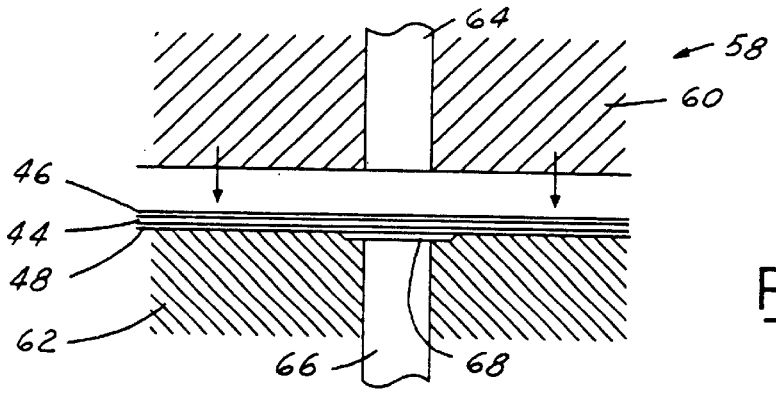
FIG. 9 is a side view of the seal material within two layers.

Referring now to FIG. 8, a different apparatus for making seal layer 26 is illustrated. In this example, a die set 58 is employed which has a first platen 60 and a second platen 62. A punch 64 is disposed within first platen 60. A back up pin 66 is disposed within second platen 62. Second platen 62 has a recess region 68 which is used to form boss area 68 as described above. Although only one punch 64, back-up pin 66, and recess region 68 are shown, it would be understood to those skilled in the art that the number of punches 64, back-up pins 66, and recess regions 68 should correspond to the number of boss areas 38 and holes 40 in seal layer 24.

Seal material 44 along with the first film 46 and the second film 48 are placed within die set 58 on second platen 62.

Figure 10:
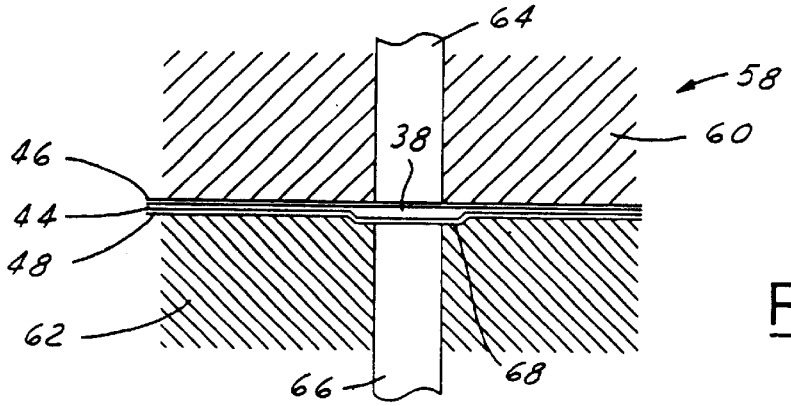
FIG. 10 is the side view of the punch acting on the seal material and the two layers.
Figure 11:
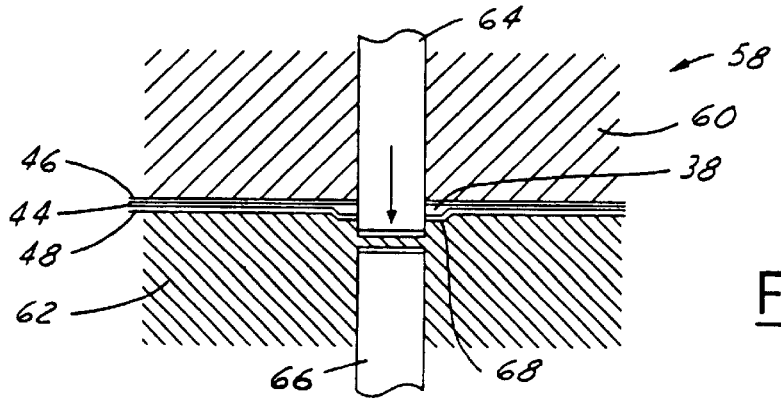
FIG. 11 is a side view of a punch acting upon the seal material to punch a hole therethrough.

Referring now to FIG. 10, first platen 60 is then brought together with second platen 60 with seal material 44 therebetween. Seal material 44 is reduced in thickness to form web portion 36 while boss area 38 is formed in recessed region 68 having a second thickness greater than web thickness 36. While first platen 60 and second platen 62 are holding seal material 44 between first film 46 and second film 48, punch 64 is drawn through boss area 38 to form holes 40. Back-up pin 66 provides resistance against punch 64. By using back-up pin 66, several beneficial results are generated: first, it helps "pack" the molding rim around the hole with uncured seal material; second, a cleaner cut edge on the punched hole is formed; and, third, stretching and distortion of the elastomer layer is reduced. Reducing stressing and distortion is particularly important to control punch patterns of many holes.

The process of applying seal material 44 to a substrate 54 is similar to that described above with respect to FIG. 7. Various alternatives for the steps shown in FIGS. 8–11 would be evident to those skilled in the art. For example, every hole 40 need not be punched simultaneously. For example, a first set of punches might punch every other hole. The sheet may also be indexed for placement into a second punch to punch the second set of holes. Alternatively, one row of holes may be punched at a single time.

In a further variation of the invention, the temperature of the seal material may be elevated above room temperature during processing. For some materials, this may assist the hole cutting and thinning processing. Heating may take place by heating the entire processing area. Heating may also take place by heating the platens used for processing.

Another variation of the invention is that the seal material may be formed and cured before application to a device.

While particular embodiments of the invention have been shown and described, numerous variations and alternate embodiments will occur to those skilled in the art. Accordingly, it is intended that the invention be limited only in terms of the appended claims.

What is claimed is:

1. A microfluidic chip assembly comprising:

a first layer having a bottom surface formed of a first material;

a second layer having a top surface formed of a second material; and a substantially planar seal layer disposed between said first layer and said second layer, formed of a third material different than the first material and the second material, said seal layer having a sheet of seal material generally having a first thickness disposed between said bottom surface and said top surface, said seal material disposed between said bottom surface and said top surface having bossed portions having a second thickness greater than the first thickness, and a plurality of holes through said bossed portions.

2. A microfluidic chip assembly as recited in claim 1 wherein said second layer is a well plate.

3. An assembly as recited in claim 1 wherein said first material is the same as said second material.

* * * * *